US007045265B2

(12) United States Patent
Horikoshi et al.

(10) Patent No.: US 7,045,265 B2
(45) Date of Patent: May 16, 2006

(54) ELECTROPHOTOGRAPHIC COLOR TONER

(75) Inventors: Yuzo Horikoshi, Kanagawa (JP); Katsuji Ebisu, Kanagawa (JP); Takahiro Kashikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 107 days.

(21) Appl. No.: 10/680,253

(22) Filed: Oct. 8, 2003

(65) Prior Publication Data

US 2004/0137349 A1 Jul. 15, 2004

(30) Foreign Application Priority Data

Oct. 11, 2002 (JP) ..... 2002-298447

(51) Int. Cl.
*G03G 9/07* (2006.01)

(52) U.S. Cl. ..... 430/108.6; 430/107.1; 430/111.4; 430/111.41

(58) Field of Classification Search ..... 430/107.1, 430/108.6, 111.4, 111.41
See application file for complete search history.

(56) References Cited

U.S. PATENT DOCUMENTS

| | | | | |
|---|---|---|---|---|
| 2,297,691 | A | 10/1942 | Carlson | |
| 4,699,863 | A | 10/1987 | Sawatari et al. | |
| 5,866,286 | A * | 2/1999 | Christy et al. | 430/45 |
| 5,897,239 | A * | 4/1999 | Caruthers | 399/54 |
| 6,066,421 | A * | 5/2000 | Julien et al. | 430/45 |
| 6,114,077 | A * | 9/2000 | Voets et al. | 430/97 |
| 6,165,666 | A | 12/2000 | Kariya | |

FOREIGN PATENT DOCUMENTS

| | | |
|---|---|---|
| JP | A 61-132959 | 6/1986 |
| JP | A 5-19525 | 1/1993 |
| JP | A 6-348101 | 12/1994 |
| JP | A 11-327192 | 11/1999 |

* cited by examiner

*Primary Examiner*—John L Goodrow
(74) *Attorney, Agent, or Firm*—Oliff & Berridge PLC

(57) ABSTRACT

Electrophotographic color toner prepared as a mixture of white toner and chromatic color toner in an electrophotographic toner composition at least containing a colorant, a binder resin and an additive, wherein a colorant of the white toner is one member selected from the group consisting of silver white pigment, titanium white pigment, zinc white pigment, and titanium strontium white pigment.

19 Claims, 9 Drawing Sheets

FIG. 3A

| | | $Y_1$ | $M_1$ | $C_1$ |
|---|---|---|---|---|
| RESIN | | 75 | 81 | 88 |
| COLORANT | | 8 | 7 | 5 |
| CHARGE CONTROL AGENT | | 2 | 2 | 2 |
| ELECTRICALLY CONDUCTIVE FINE PARTICLES | | 15 | 10 | 5 |
| AMOUNT OF ELECTRIC CHARGE | | 17.1 | 17.2 | 17.1 |
| ELECTRICAL RESISTIVITY | | 12 | 8 | 15 |
| COLOR CHARACTERISTIC | L* | 78 | 38 | 48 |
| | a* | -13 | 43 | -32 |
| | b* | 74 | 4 | -21 |
| | c* | 74.7 | 43.6 | 38.5 |

FIG. 3B

| | | $W_1$ | $W_2$ | $W_3$ | $W_4$ |
|---|---|---|---|---|---|
| RESIN | | 82 | 83 | 84 | 85 |
| COLORANT | | 10 | 7 | 5 | 3 |
| CHARGE CONTROL AGENT | | 2 | 2 | 2 | 2 |
| ELECTRICALLY CONDUCTIVE FINE PARTICLES | | 6 | 8 | 9 | 10 |
| AMOUNT OF ELECTRIC CHARGE | | 17.2 | 17.1 | 17.2 | 17.1 |
| ELECTRICAL RESISTIVITY | | 9 | 10 | 12 | 15 |
| COLOR CHARACTERISTIC | L* | 85 | 85 | 86 | 85 |
| | a* | -1 | -1 | -2 | -3 |
| | b* | 1 | 2 | 2 | 4 |
| | c* | 1.4 | 2.2 | 2.8 | 5.0 |

FIG. 3C

| | | $G_1$ | $G_2$ | $G_3$ | $G_4$ | $K_1$ |
|---|---|---|---|---|---|---|
| RESIN | | 89 | 89 | 88.5 | 87.8 | 88 |
| COLORANT | | 2 | 1 | 0.5 | 0.2 | 10 |
| CHARGE CONTROL AGENT | | 2 | 2 | 2 | 2 | 2 |
| ELECTRICALLY CONDUCTIVE FINE PARTICLES | | 7 | 8 | 9 | 10 | 0 |
| AMOUNT OF ELECTRIC CHARGE | | 16.9 | 17 | 17 | 17.1 | 17.2 |
| ELECTRICAL RESISTIVITY | | 10 | 11 | 12 | 15 | 10 |
| COLOR CHARACTERISTIC | L* | 20 | 21 | 25 | 35 | 18 |
| | a* | 1 | 1 | 1 | 1 | 1 |
| | b* | 0 | 1 | 1 | 2 | 0 |
| | c* | 1.0 | 1.4 | 1.4 | 2.2 | 1.0 |

FIG. 4A

| | | $Y_5$ | $M_5$ | $C_5$ |
|---|---|---|---|---|
| RESIN | | 91 | 92 | 93 |
| COLORANT | | 7 | 6 | 5 |
| CHARGE CONTROL AGENT | | 2 | 2 | 2 |
| ELECTRICALLY CONDUCTIVE FINE PARTICLES | | 0 | 0 | 0 |
| AMOUNT OF ELECTRIC CHARGE | | 17.5 | 17.4 | 17.3 |
| ELECTRICAL RESISTIVITY | | 150 | 100 | 60 |
| COLOR CHARACTERISTIC | L* | 79 | 39 | 47 |
| | a* | -10 | 43 | -33 |
| | b* | 75 | 4 | -20 |
| | c* | 75.7 | 43.6 | 38.6 |

FIG. 4B

| | | $W_5$ | $G_5$ |
|---|---|---|---|
| RESIN | | 88 | 96 |
| COLORANT | | 10 | 2 |
| CHARGE CONTROL AGENT | | 2 | 2 |
| ELECTRICALLY CONDUCTIVE FINE PARTICLES | | 0 | 0 |
| AMOUNT OF ELECTRIC CHARGE | | 17.3 | 17.4 |
| ELECTRICAL RESISTIVITY | | 45 | 60 |
| COLOR CHARACTERISTIC | L* | 86 | 20 |
| | a* | -1 | 1 |
| | b* | 1 | 1 |
| | c* | 1.4 | 1.4 |

FIG. 5

| | CHROMATIC COLOR | | | WHITE TONER | | | | GREY TONER | | | | BLACK | CHROMATIC COLOR | | | ACHROMATIC COLOR | |
|---|---|---|---|---|---|---|---|---|---|---|---|---|---|---|---|---|---|
| | $Y_1$ | $M_1$ | $C_1$ | $W_1$ | $W_2$ | $W_3$ | $W_4$ | $G_1$ | $G_2$ | $G_3$ | $G_4$ | $K_1$ | $Y_5$ | $M_5$ | $C_5$ | $W_5$ | $G_5$ |
| EXAMPLE 1 | 25 | 25 | | 50 | | | | | | | | | | | | | |
| EXAMPLE 2 | 35 | 35 | | 30 | | | | | | | | | | | | | |
| EXAMPLE 3 | 45 | 45 | | 10 | | | | | | | | | | | | | |
| EXAMPLE 4 | 15 | 15 | | 70 | | | | | | | | | | | | | |
| EXAMPLE 5 | 5 | 5 | | 90 | | | | | | | | | | | | | |
| EXAMPLE 6 | 25 | 25 | | | 50 | | | | | | | | | | | | |
| EXAMPLE 7 | 25 | 25 | | | | 50 | | | | | | | | | | | |
| EXAMPLE 8 | 25 | 25 | | | | | 50 | | | | | | | | | | |
| EXAMPLE 9 | 20 | | 30 | 50 | | | | | | | | | | | | | |
| EXAMPLE 10 | | | 80 | 20 | | | | | | | | | | | | | |
| EXAMPLE 11 | | 40 | 30 | 30 | | | | | | | | | | | | | |
| REFERENCE EXAMPLE 1 | 25 | 25 | | | | | | | | | | 50 | | | | | |
| REFERENCE EXAMPLE 2 | 35 | 35 | | | | | | | | | | 30 | | | | | |
| REFERENCE EXAMPLE 3 | 45 | 45 | | | | | | | | | | 10 | | | | | |
| REFERENCE EXAMPLE 4 | 15 | 15 | | | | | | | | | | 70 | | | | | |
| REFERENCE EXAMPLE 5 | 5 | 5 | | | | | | | | | | 90 | | | | | |
| REFERENCE EXAMPLE 6 | 25 | 25 | | | | | | 50 | | | | | | | | | |
| REFERENCE EXAMPLE 7 | 35 | 35 | | | | | | 30 | | | | | | | | | |
| REFERENCE EXAMPLE 8 | 45 | 45 | | | | | | 10 | | | | | | | | | |
| REFERENCE EXAMPLE 9 | 15 | 15 | | | | | | 70 | | | | | | | | | |
| REFERENCE EXAMPLE 10 | 5 | 5 | | | | | | 90 | | | | | | | | | |
| REFERENCE EXAMPLE 11 | 25 | 25 | | | | | | | 50 | | | | | | | | |
| REFERENCE EXAMPLE 12 | 25 | 25 | | | | | | | | 50 | | | | | | | |
| REFERENCE EXAMPLE 13 | 25 | 25 | | | | | | | | | 50 | | | | | | |
| REFERENCE EXAMPLE 14 | 20 | | 30 | | | | | 50 | | | | | | | | | |
| REFERENCE EXAMPLE 15 | 60 | | 30 | | | | | 10 | | | | | | | | | |
| COMPARATIVE EXAMPLE 1 | | | | | | | | | | | | | 25 | 25 | | 50 | |
| COMPARATIVE EXAMPLE 2 | | | | | | | | | | | | | 25 | 25 | | | 50 |
| COMPARATIVE EXAMPLE 3 | | | | | | | | | | | | 50 | 25 | 25 | | | |

FIG. 6

| | CHROMATIC COLOR | ACHROMATIC COLOR | $R_H/R_L$ | BEFORE CONTINUOUS PRINTING | | | AFTER CONTINUOUS PRINTING | | | COLOR DIFFERENCE |
|---|---|---|---|---|---|---|---|---|---|---|
| | | | | L* | a* | b* | L* | a* | b* | ΔE |
| EXAMPLE 1 | 50 | 50 | 1.5 | 68 | 14 | 25 | 71 | 15 | 26 | 3.3 |
| EXAMPLE 2 | 70 | 30 | 1.5 | 64 | 18 | 33 | 66 | 17 | 35 | 3.0 |
| EXAMPLE 3 | 90 | 10 | 1.5 | 60 | 22 | 40 | 62 | 22 | 42 | 2.8 |
| EXAMPLE 4 | 30 | 70 | 1.5 | 73 | 9 | 17 | 72 | 9 | 20 | 3.2 |
| EXAMPLE 5 | 10 | 90 | 1.5 | 80 | 4 | 9 | 78 | 4 | 11 | 2.8 |
| EXAMPLE 6 | 50 | 50 | 1.25 | 67 | 15 | 25 | 68 | 15 | 25 | 1.0 |
| EXAMPLE 7 | 50 | 50 | 1.5 | 67 | 15 | 26 | 67 | 14 | 27 | 1.4 |
| EXAMPLE 8 | 50 | 50 | 1.88 | 68 | 15 | 25 | 65 | 15 | 29 | 5.0 |
| EXAMPLE 9 | 50 | 50 | 1.67 | 66 | -15 | 0 | 66 | -13 | -2 | 2.8 |
| EXAMPLE 10 | 80 | 20 | 1.67 | 55 | -25 | -18 | 53 | -25 | -19 | 2.4 |
| EXAMPLE 11 | 70 | 30 | 1.88 | 58 | 10 | -5 | 56 | 6 | -7 | 4.9 |
| REFERENCE EXAMPLE 1 | 50 | 50 | 1.5 | 36 | 16 | 25 | 39 | 17 | 27 | 3.7 |
| REFERENCE EXAMPLE 2 | 70 | 30 | 1.5 | 43 | 19 | 33 | 45 | 20 | 35 | 3.0 |
| REFERENCE EXAMPLE 3 | 90 | 10 | 1.5 | 50 | 22 | 41 | 52 | 22 | 42 | 2.2 |
| REFERENCE EXAMPLE 4 | 30 | 70 | 1.5 | 26 | 10 | 17 | 28 | 11 | 19 | 3.0 |
| REFERENCE EXAMPLE 5 | 10 | 90 | 1.5 | 22 | 5 | 8 | 23 | 5 | 10 | 2.2 |
| REFERENCE EXAMPLE 6 | 50 | 50 | 1.5 | 42 | 15 | 25 | 43 | 14 | 27 | 2.4 |
| REFERENCE EXAMPLE 7 | 70 | 30 | 1.5 | 48 | 19 | 34 | 50 | 19 | 35 | 2.2 |
| REFERENCE EXAMPLE 8 | 90 | 10 | 1.5 | 53 | 22 | 40 | 55 | 22 | 41 | 2.2 |
| REFERENCE EXAMPLE 9 | 30 | 70 | 1.5 | 33 | 10 | 18 | 35 | 10 | 19 | 2.2 |
| REFERENCE EXAMPLE 10 | 10 | 90 | 1.5 | 25 | 5 | 9 | 26 | 5 | 10 | 1.4 |
| REFERENCE EXAMPLE 11 | 50 | 50 | 1.5 | 44 | 16 | 26 | 46 | 15 | 29 | 3.7 |
| REFERENCE EXAMPLE 12 | 50 | 50 | 1.5 | 46 | 15 | 26 | 45 | 15 | 29 | 3.2 |
| REFERENCE EXAMPLE 13 | 50 | 50 | 1.88 | 48 | 14 | 25 | 44 | 13 | 27 | 4.6 |
| REFERENCE EXAMPLE 14 | 50 | 50 | 1.50 | 33 | -13 | 1 | 35 | -13 | 1 | 2.0 |
| REFERENCE EXAMPLE 15 | 90 | 10 | 1.50 | 50 | -15 | 40 | 52 | -14 | 37 | 3.7 |
| COMPARATIVE EXAMPLE 1 | 50 | 50 | 3.33 | 72 | 13 | 23 | 61 | 15 | 29 | 12.7 |
| COMPARATIVE EXAMPLE 2 | 50 | 50 | 2.5 | 38 | 14 | 23 | 45 | 12 | 28 | 8.8 |
| COMPARATIVE EXAMPLE 3 | 50 | 50 | 15 | 30 | 13 | 22 | 49 | 14 | 35 | 23.0 |

ELECTROPHOTOGRAPHIC COLOR TONER

The present disclosure relates to the subject matter contained in Japanese Patent Application No.2002-298447 filed Oct. 11, 2002, which is incorporated herein by reference in its entirety.

BACKGROUND OF THE INVENTION

1. Field of the Invention

The present invention relates to an electrophotographic color toner and particularly to an electrophotographic color toner, which is prepared as a mixture of an achromatic white toner and a chromatic color toner containing at least one member selected from yellow, magenta, cyan, etc. and which has the configuration for enlarging a color reproduction region of the color toner and stabilizing developing characteristic of the color toner.

2. Description of the Related Art

An electrophotography is a technique widely used in an image forming apparatus such as a copying machine, an electrophotographic facsimile machine or an electrophotographic printer. A method using a photoconductive electrical insulator is generally used as the electrophotography (U.S. Pat. No. 2,297,691).

This method is carried out as follows. Light emitted from a laser, an LED, etc. is applied onto a photoconductive electrical insulator charged by corona discharge or by a charge-supply roller to thereby form an electrostatic latent image. Then, resin powder colored by pigment or dye and called "toner" is electrostatically deposited on the electrostatic latent image and developed to thereby form a visualized toner image. Then, the toner image is transferred onto a recording medium such as a sheet of paper or a film.

On this occasion, it is necessary to fix the toner image onto the recording medium because the toner image is an image of powder merely put on the recording medium.

Therefore, in a final step, the toner deposited on the recording medium is melted by heat, pressure, light or the like and then solidified to thereby finally obtain a toner image fixed onto the recording medium.

As described above, fixing of toner is performed in such a manner that toner, which is powder containing a thermoplastic resin (hereinafter referred to as binder resin) as a main component, is melted by heat and fixed onto the recording medium. As methods for fixing toner, there are commonly known a heat roll method using rollers for directly heating and pressurizing the recording medium having the toner image formed thereon, and a flash fixing method for fixing toner onto the recording medium by flash light emitted from an xenon flash lamp or the like.

To obtain a color image, there are known a printing method for performing color printing by developing and superposing three kinds of color toner, namely, yellow toner, magenta toner and cyan toner or four kinds of color toner inclusive of black toner in addition to the three kinds of color toner, and a printing method for performing color printing by superposing at least two kinds of black or color toner (JP-A-Sho.61-132959 and U.S. Pat. No. 4,699,863).

In the former printing method, the four kinds of color toner, namely, yellow toner, magenta toner, cyan toner and black toner, are set in an yellow developing unit, a magenta developing unit, a cyan developing unit and a black developing unit respectively. When the respective kinds of color toner are developed, a print image is formed.

In this case, if the developing condition is optimized, developing characteristic can be kept constant even when the respective kinds of color toner are different in physical solid-state properties. The apparatus is however complex in structure, so that the cost of the apparatus becomes high.

In the latter printing method, color printing can be performed if at least one developing unit can be provided for developing color toner. The apparatus is simple in structure, so that the cost of the apparatus becomes low.

As an apparatus using the latter printing method, there is known a printing apparatus having a fluidized bed in which kinds of toner substantially equal in physical properties but different in color are mixed homogeneously at a predetermined ratio (JP-A-Hei.6-348101 and U.S. Pat. No. 5,866,286).

Heretofore, electrical resistivity of toner has been adjusted by a method of adding an electrically conductive additive to the toner. In a two-component developing agent containing toner and a magnetic carrier, electrical resistivity can be controlled when electrical conductivity of a core material or a coating material of the magnetic carrier combined with the toner is adjusted.

For example, a method of adding an electrically conductive additive to toner is known as a method for controlling electrical resistivity of the toner (JP-A-Hei.5-19525, JP-A-Hei.11-327192, and U.S. Pat. No. 6,165,666).

This is a technique for internally or externally adding an electrically conductive additive to color toner to thereby change electrical resistivity of the color toner.

When at least two kinds of toners selected from yellow toner, magenta toner, cyan toner, black toner, etc. are mixed in this manner, color toner having any color can be provided.

To perform color printing by the latter printing method, various kinds of color toner need to be prepared in accordance with various print colors. To obtain various kinds of color toner, colorants of various materials need to be used.

When the material of the colorant varies, electrical resistivity of color toner, however, varies according to electrical resistivity of the colorant. For this reason, whenever color toner is provided, it is necessary to control electrical resistivity of the color toner accurately in order to use the color toner in a developing unit in the same condition. In order to control electrical resistivity accurately, it is necessary to repeat enormous experimentation and evaluation. There is a problem that it is actually impossible to provide various kinds of color toner.

Even if various kinds of color toner were provided by using colorants changed by the aforementioned method, it is necessary to clean piping and production equipment whenever a color toner product different in color is to be produced because diversified color toner products must be produced. There is a problem that a large demerit occurs in production cost or the like.

That is, though various kinds of color toner can be provided when at least two kinds of toner selected from yellow toner, magenta toner and cyan toner are mixed, the yellow toner, the magenta toner and the cyan toner are different in electrical resistivity because a yellow pigment, a magenta pigment and a cyan pigment used as colorants in the yellow toner, the magenta toner and the cyan toner respectively are widely different in electrical resistivity.

If color toner obtained by combination/mixing of these kinds of color toner different in electrical resistivity is printed, these kinds of color toner combined are developed unevenly. There is a problem that the color tone of a print image becomes unstable.

For this reason, there is required a method for accurately adjusting electrical resistivities of yellow toner, magenta toner and cyan toner in which a yellow pigment, a magenta pigment and a cyan pigment different in electrical resistivity are contained respectively.

The color that can be reproduced by color toner prepared by mixing of yellow toner, magenta toner and cyan toner is limited to a predetermined range in an L*a*b* color space. This situation will be described with reference to FIG. 9.

Refer to FIG. 9.

That is, though it is possible to reproduce any color on a closed curve Y-L-A-B-M-D-E-F-C-G-H-J-Y shown in FIG. 9 when the mixture ratio of these kinds of toner is changed, it is impossible to reproduce any other color in the inside of the curve and any other color different in terms of a lightness axis L* perpendicular to an a*-b* plane.

Therefore, an improved color adjusting method needs to be provided in order to reproduce other colors than the colors taken on the closed curve Y-L-A-B-M-D-E-F-C-G-H-J-Y.

SUMMARY OF THE INVENTION

Therefore, an object of the invention is to provide various kinds of color toner capable of developing images of sharp color tones stably.

FIG. 1 is a graph for explaining the color reproduction range of color toner in the case where white toner is mixed with the color toner.

Refer to FIG. 1.

To achieve the foregoing object, a first aspect of the invention provides an electrophotographic color toner including a white toner and a color toner. The white toner and the color toner each includes a colorant, a binder resin, and an additive. The white toner and the color toner are mixed. The colorant of the white toner is selected from a group consisting of silver white pigment, titanium white pigment, zinc white pigment, and titanium strontium white pigment.

When white toner is mixed with chromatic color toner in this manner, it is possible to reproduce all colors in a space put in a curved surface connecting a closed curve Y-L-A-B-M-D-E-F-C-G-H-J-Y and a point W to each other as shown in FIG. 1.

Preferably, a colorant of the white toner is one member selected from the group consisting of silver white pigment, titanium white pigment, zinc white pigment, and titanium strontium white pigment.

Preferably, in this case, a print color of the chromatic color toner satisfies the relation $(a^*)^2+(b^*)^2 \geqq 10$ in an L*a*b* color space. As a result, various kinds of color toners in a range of from color toner having high color saturation $C^*$ $(=(a^{*2}+b^{*2})^{1/2})$ to color toner having low color saturation $C^*$ can be obtained when the chromatic color toner is mixed with the white toner.

Preferably, a print color of the white toner satisfies the relation $(a^*)^2+(b^*)^2 \leqq 5$ in an L*a*b* color space. As a result, the influence of the chromatic color toner on color saturation $C^*$ can be reduced when the white toner is mixed with the chromatic color toner.

Preferably, a print color of the white toner satisfies the relation $L^* \geqq 80$ in an L*a*b* color space. As a result, color toner having high lightness $L^*$ can be obtained when the white toner is mixed with the chromatic color toner.

Preferably, electrically conductive fine particles are used as additives in order to control electrical resistivity of the white toner effectively. The electrical resistivity of the electrically conductive fine particles is preferably selected to be in a range of from 1 Ω·cm to 100 Ω·cm. As a result, the problem of variation in print color at the time of continuous printing can be solved.

If the electrical resistivity of the electrically conductive fine particles is lower than 1 Ω·cm, the electrostatic characteristic of the toner is lowered so that fogging occurs. If the electrical resistivity of the electrically conductive fine particles is higher than 100 Ω·cm, sufficient electrical conductivity cannot be obtained.

The organic pigment or dye is the highest in electrical resistivity. The white inorganic pigment is high in electrical resistivity. Therefore, electrically conductive fine particles are preferably added as additives to the chromatic color toner and the white toner which contain the organic pigment or dye and the white inorganic pigment in order to control electrical resistivity of each toner in accordance with electrical resistivity of the colorant.

Preferably, the ratio $R_H/R_L$ of electrical resistivity $R_H$ of toner having the highest electrical resistivity to electrical resistivity $R_L$ of toner having the lowest electrical resistivity in the two or more kinds of toner is selected to be not higher than 2. As a result, stability good in color tone can be obtained.

If the electrical resistivity ratio $R_H/R_L$ in kinds of toner mixed is higher than 2, these kinds of toner mixed are developed and consumed so unevenly that the color tone of the print image becomes unstable.

Incidentally, kinds of toner having hues of yellow, magenta and cyan respectively are preferably used as the kinds of color toner different in hue. Alternatively, kinds of toner having hues of green, blue and red may be used.

The color toner prepared by a mixture of chromatic color toner and white toner is stored in a toner cartridge. When the toner cartridge is set in an image forming apparatus, stable image quality can be provided.

BRIEF DESCRIPTION OF THE DRAWINGS

FIGS. 3A to 3C are tables for explaining characteristics of kinds of toner used in Examples according to the invention.

FIGS. 4A and 4B are tables for explaining characteristics of kinds of toner used in Comparative Examples.

FIG. 5 is a table for explaining composition ratios of various kinds of color toner.

FIG. 6 is a table for explaining characteristics of various kinds of color toner.

DETAILED DESCRIPTION OF THE PREFERRED EMBODIMENTS

Figure 1:
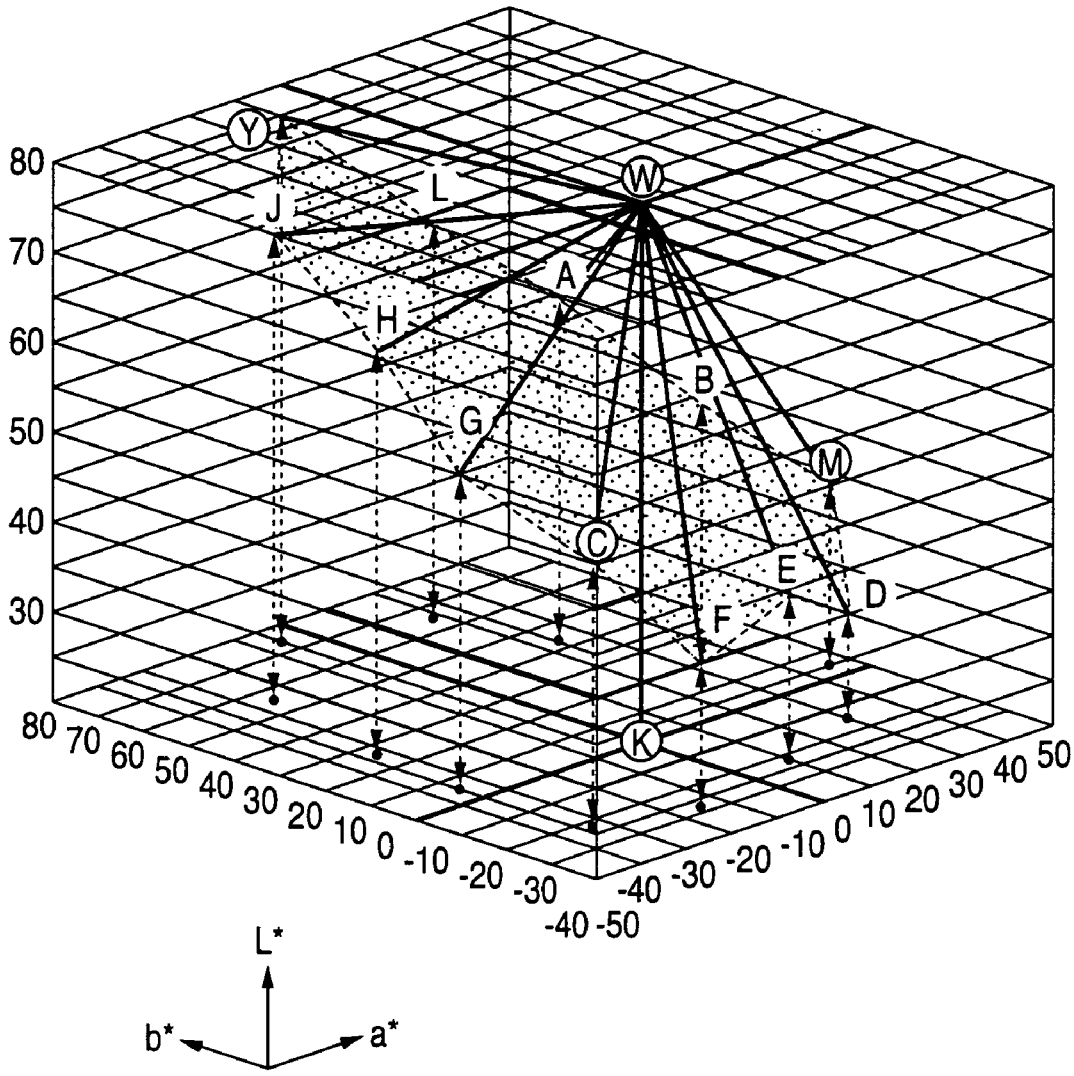
FIG. 1 is a graph for explaining a theoretical configuration of the invention.

A preferred procedure for carrying out an embodiment of the invention will be described below.

A color toner according to the embodiment of the invention can be produced by a production method known as the related art. A raw material of the color toner at least contains a binder resin, a colorant, and electrically conductive fine particles. A charge control agent and wax may be added to the raw material, if necessary.

The raw material is kneaded, for example, by a pressurizing kneader, a roll mill, an extruder or the like so as to be dispersed evenly. Then, the raw material is pulverized and powdered impalpably, for example, by a pulverizer, a jet mill or the like and classified by a wind-force classifier or the like. Thus, basic chromatic color toner or achromatic color toner, that is, white toner, having a required grain size distribution is obtained.

Then, at least one kind of basic toner selected from yellow toner, magenta toner and cyan toner obtained in the aforementioned manner is mixed suitably in accordance with a target color tone to be obtained. At the same time, an amount of white toner corresponding to the lightness L* to be obtained is mixed with the basic toner homogeneously, for example, by a Henschel mixer or the like. Thus, electrophotographic color toner according to the embodiment of the invention is obtained.

Incidentally, mixing of the color toner and the white toner may be performed in a step of coating surfaces of toner particles with inorganic fine particles as an external additive.

In this case, a print color of the chromatic color toner is selected to satisfy the relation $(a^*)^2+(b^*)^2 \geqq 10$ in an L*a*b* color space, and a print color of the white toner is selected to satisfy the relation $(a^*)^2+(b^*)^2 \leqq 5$ in the L*a*b* color space in the condition of $L^* \geqq 80$.

In this case, for example, each color toner preferably contains 75 to 95 parts by weight of a binder resin, and 0.1 to 20 parts by weight of a colorant, preferably 0.5 to 15 parts by weight of a colorant when the total amount of the toner is 100 parts by weight.

The binder resin used in the invention is not particularly limited. A thermoplastic resin made of any kind of natural or synthetic high-molecular substance can be used as the binder resin. For example, an epoxy resin, a styrene-acrylic resin, a polyamide resin, a polyester resin, a polyvinyl resin, a polyurethane resin, a polybutadiene resin, etc. may be used singly or in combination.

The colorant contained in the color toner according to the invention is not particularly limited either. A known colorant can be used.

For example, a monoazo red pigment, a disazo yellow pigment, a quinacridone magenta pigment, an anthraquinone dye, a nigrosine dye, a quaternary ammonium salt dye, a monoazo metal complex dye, etc. may be used. These examples may be used in combination.

More specific examples of the colorant used include aniline blue (C.I.No. 50405), calco oil blue (C.I.No. Azoic Blue 3), chrome yellow (C.I.No. 14090), ultra marine blue (C.I.No. 77103), DuPont oil red (C.I.No. 26105), quinoline yellow (C.I.No. 47005), methylene blue chloride (C.I.No. 52015), phthalocyanine blue (C.I.No. 74160), malachite green oxalate (C.I.No. 42000), edible red No. 2 (amaranth, C.I.No. 16185), edible red No. 3 (erythrosine, C.I.No. 45430), edible red No. 40 (allura red AC, C.I.No. 16035), edible red No. 102 (new coccine, C.I.No. 16255), edible red No. 104 (phloxine, C.I.No. 45410), edible red No. 105 (rose bengal, C.I.No. 45440), edible red No. 106 (acid red, C.I.No. 45100), (yellow) edible yellow No. 4 (tartrazine, C.I.No. 19140), edible yellow No. 5 (sunset yellow FCF, C.I.No. 15985), (green) edible green No. 3 (fast green FCF, C.I.No. 42053), (blue) edible blue No. 1 (brilliant blue FCF, C.I.No. 42090), and edible blue No. 2 (indigo carmine, C.I.No. 73015).

Silver white, titanium white, zinc white, titanium strontium white, etc. can be used as the white pigment used in the achromatic white toner. Especially, rutile crystal-type titanium oxide or anatase crystal-type titanium oxide high in whiteness is preferred.

For example, titanium oxide with a particle size of from 10 nm to 1000 nm may be preferably used for obtaining white toner higher in pigment dispersibility.

To stabilize electrostatic characteristic of toner, the electrical resistivity of the pigment is preferably in a range of from $1\times10^8$ Ω·cm to $1\times10^{12}$ Ω·cm. If the electrical resistivity of the pigment is higher that $1\times10^{12}$ Ω·cm, appropriate electrical resistivity of toner cannot be obtained even in the case where electrically conductive fine particles, which will be described later, are used for controlling resistivity.

If the electrical resistivity of the pigment is lower than $1\times10^8$ Ω·cm, electrical conductivity of toner increases to make it undesirably difficult to stabilize electrostatic characteristic of toner.

When, for example, surfaces of the white pigment particles are treated with a silane coupling agent, silicone oil, aliphatic acid such as stearic acid, amine, alcohol, trimethanol amine or the like, simultaneous achievement of very high pigment dispersibility with toner electrostatic stability can be made easily.

A colorless or white additive having no influence on the color of toner is preferably used as the electrically conductive fine particles added for controlling electrical resistivity. When the electrical resistivity of the electrically conductive fine particles is in a range of from 1 Ω·cm to 100 Ω·cm, preferably in a range of from 1 Ω·cm to 50 Ω·cm, good electrostatic characteristic can be obtained. If white electrically conductive fine particles having resistivity lower than 1 Ω·cm are used, surface resistance becomes excessively low so that toner having sufficient specific charge cannot be obtained.

If white electrically conductive fine particles having resistivity higher than 100 Ω·cm are used, the concentration of added electrically conductive fine particles must be increased to 20% or higher. As a result, the color of toner becomes cloudy, so that a high-saturation print image cannot be obtained undesirably.

The electrically conductive fine particles preferably have an aspect ratio of not lower than 10 and a major axis size of not longer than 4 μm. The amount of the electrically conductive fine particles added is preferably not higher than 20% by weight.

Because the electrically conductive fine particles high in aspect ratio are shaped like needles, the number of contact points of the electrically conductive fine particles increases so that addition of a small amount of the electrically conductive fine particles has a large effect on reduction in electrical resistivity of toner. As a result, the amount of the electrically conductive fine particles added can be not higher than 20% by weight. Accordingly, high color saturation can be provided without white turbidity of toner.

When the electrically conductive fine particles are made of metal oxide selected from the group consisting of ZnO, $TiO_2$, $SnO_2$, $Sb_2O_3$, $In_2O_3$, $SiO_2$, MgO, BaO, $MoO_3$ and WO, both good developability and sharp image formability can be provided. This is because the metal oxide has a color having little influence on the color of color toner.

When particles of titanium dioxide ($TiO_2$) having a major axis size of not shorter than 1 μm and a minor axis size of not longer than 0.1 μm account for 50% by weight or higher with respect to the total amount of the titanium dioxide, especially both good developability and sharp image formability can be obtained.

This is because a small amount of acicular titanium oxide is particularly effective in controlling resistivity as well as the shape having a major axis size of not shorter than 1 μm and a minor axis size of not longer than 0.1 μm is effective in controlling resistivity.

That is, the longer the electrically conductive fine particles are, the better the shape thereof is. As the aspect ratio of the electrically conductive fine particles increases, a small amount of the electrically conductive fine particles added is more effective in reducing electrical resistivity of toner. Further, when electrically conductive fine particles having a major axis size of not shorter than 1 μm and a minor axis size of not longer than 0.1 μm account for 50% by weight or higher with respect to the total amount of electrically conductive fine particles, the electrically conductive fine particles are particularly effective in controlling resistivity.

Preferably, an electrically conductive layer including tin oxide ($SnO_2$) and antimony oxide ($Sb_2O_3$) is provided on each of surfaces of the titanium dioxide particles in order to obtain particularly both good developability and sharp image formability.

This is because the electrically conductive layer is particularly effective in controlling resistivity so that the amount of the electrically conductive fine particles added can be reduced more greatly.

Preferably, the amount of antimony oxide is in a range of from 10% by weight to 25% by weight in terms of $Sb_2O_3$ with respect to the amount of $SnO_2$ in order to obtain particularly both good developability and sharp image formability.

This is because resistivity of titanium oxide can be minimized in this condition.

Preferably, tin oxide ($SnO_2$) particles having a major axis size of not shorter than 1 μm and a minor axis size of not longer than 0.1 μm account for 50% by weight with respect to the total amount of tin oxide particles in order to obtain particularly both good developability and sharp image formability.

This is because a small amount of acicular tin oxide is effective in controlling resistivity and because the shape having a major axis size of not shorter than 1 μm and a minor axis size of not longer than 0.1 μm is effective in controlling resistivity.

Preferably, an electrically conductive layer made of antimony oxide ($Sb_2O_3$) is provided on each of surfaces of tin oxide particles in order to obtain particularly both good developability and sharp image formability.

This is because the electrically conductive layer is particularly effective in controlling resistivity so that the amount of the electrically conductive fine particles added can be reduced more greatly.

In this case, the material and added amount of electrically conductive fine particles are preferably adjusted so that the ratio $R_H/R_L$ of resistivity $R_H$ of toner highest in resistivity to resistivity $R_L$ of toner lowest in resistivity in electrical resistivity of yellow toner, magenta toner, cyan toner and white toner used in color toner prepared as a mixture of kinds of toner according to the embodiment of the invention is not higher than 2.0.

A method for measuring electrical resistivity of electrically conductive fine particles will be described below.

First, electrically conductive fine particles are molded under a pressure of 100 kg/cm$^2$ to form columnar pressed powder having a diameter of 20 mm and a thickness of 1 mm to 5 mm. DC electrical resistance of the columnar pressed powder is measured, so that electrical resistivity of white electrically conductive fine particles is calculated by the following expression.

Electrical Resistivity (Ω·cm)=Measured Value×(Sectional Area/Thickness)

Incidentally, in this case, the electrical resistance is measured by a high-voltage source-measure unit (trade name: KEITHLEY 237, made by KEITHLEY INSTRUMENTS, INC.).

A charge control agent may be added to the color toner according to the embodiment of the invention in order to provide stable electrostatic characteristic and reduce variation in the amount of electrostatic charge under different temperature and humidity environments. A colorless or light-color agent may be preferably used as the charge control agent.

Examples of the charge control agent used may include known positive or negative charge control agents such as a quaternary ammonium salt compound, a salicylic compound, a boron complex, and a carboxylic compound.

Toner surfaces may be coated within organic fine particles as an external additive in order to improve fluidity of the color toner according to the embodiment of the invention. The particle size of the external additive used here is in a range of from 5 nm to 2 μm, preferably in a range of from 5 nm to 500 nm. The specific surface area of the external additive measured by a BET method is preferably in a range of from 20 m$^2$/g to 500 m$^2$/g.

The amount of the external additive added to the color toner according to the embodiment of the invention is in a range of from 0.1 parts by weight to 5 parts by weight, preferably in a range of from 0.1 parts by weight to 2.0 parts by weight with respect to 100 parts by weight of toner.

Examples of the external additive may include fine particles such as silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

Especially, silica fine particles may be preferably used. Surfaces of fine particles of the external additive may be preferably treated so as to be made hydrophobic.

A method for measuring electrical resistivity of the color toner produced from the aforementioned material by the aforementioned procedure will be described below.

First, toner particles are press-molded under a pressure of 5,000 kg/cm$^2$ to form columnar pressed powder having a diameter of 13 mm and a thickness of from 200 μm to 500 μm. Electrical conductivity of the pressed powder is measured with a dielectric loss measuring unit (made by ANDO ELECTRIC CO., LTD.), so that the electrical resistivity of the color toner is calculated by the following expression:

Electrical Resistivity (Ω·cm)=$S/(Ld)$ in which S is the bottom area (cm$^2$) of the columnar pressed powder, d is the thickness (cm) of the columnar pressed powder, and L is the electrical conductivity ($\Omega^{-1}$) of the columnar pressed powder.

Then, a printing test is applied to the color toner.

In this case, a high-speed development type color laser printer such as F6708B (trade name, made by FUJITSU LIMITED, 50 copies per minute) having a process speed of 1,100 mm/s is used as an image forming apparatus. For example, printing of 100,000 copies or more is carried out for evaluation of stability of the print color.

The conceptual configuration of the image forming apparatus used in this embodiment of the invention will be described below with reference to FIG. 2.

Figure 2:
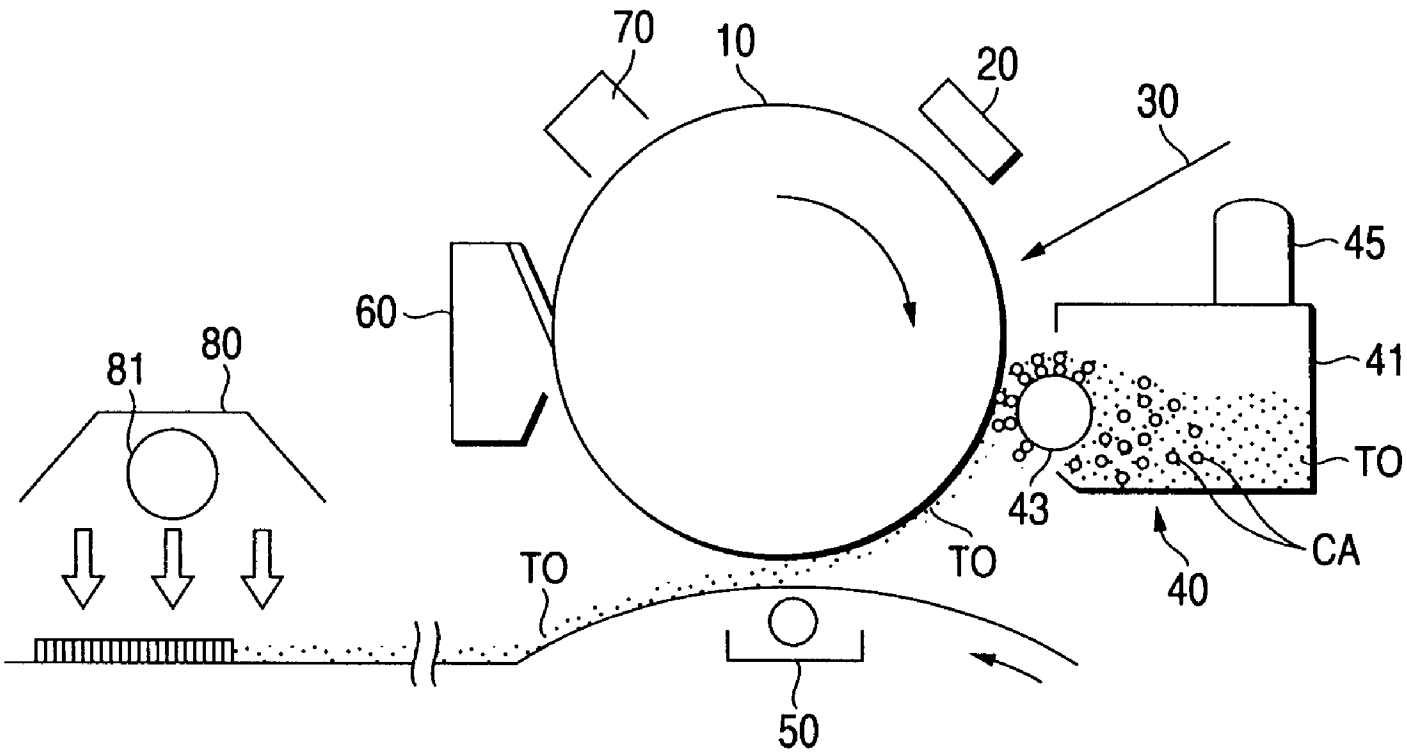
FIG. 2 is a diagram showing a conceptual configuration of an image forming apparatus used in an embodiment of the invention.

Refer to FIG. 2.

FIG. 2 is a diagram showing the conceptual configuration of the color laser printer used in the printing test. A charger 20, an exposure unit 30, a developing unit 40, a transfer unit 50, a cleaner 60, a destaticizer 70, a flash fixing unit 80 having a xenon flash lamp 81, etc. are disposed in the periphery of a photoconductor 10 made of amorphous silicon.

The developing unit 40 includes a developing agent container 41, a developing roller 43, a not-shown stirring blade, etc. Toner particles TO and carrier particles CA in the developing agent container 41 are brought into contact with one another so that a predetermined amount of electrostatic charge is given to the toner.

The color toner according to the invention is set in a toner hopper 45 in advance. When the toner density in the developing agent container 41 is reduced with the advance of printing, the toner hopper 45 supplies the color toner into the developing agent container 41.

When the color toner set in the toner hopper 45 and the developing agent container 41 is changed, toner having various color tones can be printed.

The color toner according to the invention will be described below more specifically on the basis of Examples.

Specific Examples according to the invention will be described below on the assumption of the aforementioned condition in connection with Comparative Examples in order to make the effect of Examples according to the invention clear. First, a method for producing various kinds of basic toner as a premise of Examples and Comparative Examples will be described.

Incidentally, color toner prepared by mixing of gray toner and black toner will be described for the sake of reference.

(Yellow Toner $Y_1$)

First, to produce yellow toner $Y_1$, the following materials were put into a Henschel mixer and pre-mixed.

| | |
|---|---|
| Binder Resin: polyester resin (made by KAO CORPORATION) | 75 parts by weight |
| Colorant: yellow pigment (trade name: Toner Yellow HG, made by CLARIANT CORPORTION) | 8 parts by weight |
| Negative Charge Control Agent: E-89 (trade name, made by ORIENT CHEMICAL INDUSTRIES, LTD.) | 1 part by weight |
| Electrically Conductive Agent: electroconductive titanium dioxide (trade name: FT-1000, made by ISHIHARA TECHNO CORP.) | 5 parts by weight |

Then, the mixture was kneaded by an extruder and then roughly pulverized by a hammer mill. Then, the mixture was finely pulverized by a jet mill and classified by an air flow classifier. Thus, yellow toner $Y_1$ having a volume average particle size of about 8.5 μm was obtained.

Incidentally, the acicular titanium dioxide (tradename: FT-1000, made by ISHIHARA TECHNO CORP.) was provided in the form of acicular fine particles having electrical resistivity of 5 Ω·cm, an average major axis size of 2.5 μm and an aspect ratio of 11.

Then, 1 part by weight of hydrophobic silica fine particles (trade name: H2000/4, made by CLARIANT CORPORTION) was externally added to the toner $Y_1$ and stirred by a Henschel mixer to perform an external additive process. Thus, hydrophobic silica was deposited on particle surfaces of the yellow toner $Y_1$.

In a ball mill, 5 parts by weight of the surface-modified yellow toner $Y_1$ and 95 parts by weight of silicone resin-coated magnetite carrier (made by KANTO DENKA KOGYO CO., LTD.) were mixed to obtain a two-component developing agent.

Then, the amount of electrostatic charge on the two-component developing agent was measured with a blowoff electrostatic charge measuring unit (made by TOSHIBA CHEMICAL CORPORTION). As a result, the amount of electrostatic charge was −17.1 μC/g.

On the other hand, a solid image was printed by the color laser printer (trade name: F6708B, made by FUJITSU LIMITED). The measured color of the solid image was L*=78, a*=−13 and b*=47. The electrical resistivity of the solid image was 12 G Ω·cm.

(Magenta Toner $M_1$)

Magenta toner $M_1$ was produced in the same manner as the yellow toner $Y_1$ except the kind of the colorant and the amount of the electrically conductive fine particles added.

| | |
|---|---|
| Colorant: magenta pigment (trade name: Toner Magenta EB, made by CLARIANT CORPORTION) | 7 parts by weight |
| Electrically Conductive Fine Particles: electroconductive titanium dioxide (trade name: FT-1000, made by ISHIHARA TECHNO CORP.) | 10 parts by weight |

(Cyan Toner $C_1$)

Cyan toner $C_1$ was produced in the same manner as the yellow toner $Y_1$ except the kind of the colorant and the amount of the electrically conductive fine particles added.

| | |
|---|---|
| Colorant: cyan pigment (trade name: Lionol Blue ES, made by TOYO INK MFG. CO., LTD.) | 5 parts by weight |
| Electrically Conductive Fine Particles: electroconductive titanium dioxide (trade name: FT-1000, made by ISHIHARA TECHNO CORP.) | 5 parts by weight |

Refer to FIG. 3A.

Each of the magenta toner $M_1$ and the cyan toner $C_1$ was surface-modified in the same manner as the yellow toner $Y_1$. Then, the surface-modified toner was mixed with a silicone resin-coated magnetite carrier (made by KANTO DENKA-KOGYO CO., LTD.) in a ball mill to obtain a two-component developing agent. The amount of electrostatic charge on the thus obtained developing agent, the print color of the color toner and the electrical resistivity of the color toner were measured. FIG. 3A shows results of measurement of the magenta toner $M_1$ and the cyan toner $C_1$ in addition to the result of measurement of the yellow toner $Y_1$.

(White Toner $W_1$ to $W_4$)

White toner was produced in the same manner as the yellow toner $Y_1$ except the kind of the colorant and the amount of the electrically conductive fine particles added. The white toner was surface-modified in the same manner as the yellow toner $Y_1$. The surface-modified white toner was mixed with a silicone resin-coated magnetite carrier (made by KANTO DENKA KOGYO CO., LTD.) in a ball mill to obtain a two-component developing agent. The amount of electrostatic charge on the thus obtained developing agent, the print color of the color toner and the electrical resistivity of the color toner were measured. FIG. 3B shows results of the measurement.

Refer to FIG. 3B.

| (White Toner $W_1$) | |
|---|---|
| Colorant: white pigment (trade name: KA-30S, made by TITAN KOGYO KABUSHIKI KAISHA) | 10 parts by weight |
| Electrically Conductive Fine Particles: electroconductive titanium dioxide (trade name: FT-1000, made by ISHIHARA TECHNO CORP.) | 6 parts by weight |

| (White Toner $W_2$) | |
|---|---|
| Colorant: white pigment (tradename: KA-30S, made by TITAN KOGYO KABUSHIKI KAISHA) | 7 parts by weight |
| Electrically Conductive Fine Particles: electroconductive titanium dioxide (trade name: FT-1000, made by ISHIHARA TECHNO CORP.) | 8 parts by weight |

| (White Toner $W_3$) | |
|---|---|
| Colorant: white pigment (trade name: KA-30S, made by TITAN KOGYO KABUSHIKI KAISHA) | 5 parts by weight |
| Electrically Conductive Fine Particles: electroconductive titanium dioxide (trade name: FT-1000, made by ISHIHARA TECHNO CORP.) | 9 parts by weight |

| (White Toner $W_4$) | |
|---|---|
| Colorant: white pigment (trade name: KA-30S, made by TITAN KOGYO KABUSHIKI KAISHA) | 3 parts by weight |
| Electrically Conductive Fine Particles: electroconductive titanium dioxide (trade name: FT-1000, made by ISHIHARA TECHNO CORP.) | 10 parts by weight |

(Gray Toner $G_1$ to $G_4$ and Black Toner $K_1$)

Reference toner was produced in the same manner as the yellow toner $Y_1$ except the kind of the colorant and the amount of the electrically conductive fine particles added. The reference toner was surface-modified in the same manner as the yellow toner $Y_1$. The surface-modified reference toner was mixed with a silicone resin-coated magnetite carrier (made by KANTO DENKA KOGYO CO., LTD.) in a ball mill to obtain a two-component developing agent. The amount of electrostatic charge on the thus obtained developing agent, the print color of the color toner and the electrical resistivity of the color toner were measured. FIG. 3C shows results of the measurement.

Refer to FIG. 3C.

Then, color toner, white toner and gray toner without addition of any electrically conductive fine particles were produced to form color toner as Comparative Examples for confirming the operation and effect of the invention.

Reference toner was produced in the same manner as the yellow toner $Y_1$ except the amount of the colorant added and addition of no electrically conductive fine particles. The reference toner was surface-modified in the same manner as the yellow toner $Y_1$. The surface-modified reference toner was mixed with a silicone resin-coated magnetite carrier (made by KANTO DENKA KOGYO CO., LTD.) in a ball mill to obtain a two-component developing agent. The amount of electrostatic charge on the thus obtained developing agent, the print color of the color toner and the electrical resistivity of the color toner were measured. FIG. 4A shows results of the measurement about chromatic color toner ($Y_5$, $M_5$ and $C_5$). FIG. 4B shows results of the measurement about achromatic color toner ($W_5$ and $G_5$)

Refer to FIGS. 4A and 4B.

| (Gray Toner $G_1$) | |
|---|---|
| Colorant: carbon black (trade name: Mogul L, made by CABOT CORPORATION) | 2 parts by weight |
| Electrically Conductive Fine Particles: electroconductive titanium dioxide (trade name: FT-1000, made by ISHIHARA TECHNO CORP.) | 7 parts by weight |

| (Gray Toner $G_2$) | |
|---|---|
| Colorant: carbon black (trade name: Mogul L, made by CABOT CORPORATION) | 1 part by weight |
| Electrically Conductive Fine Particles: electroconductive titanium dioxide (trade name: FT-1000, made by ISHIHARA TECHNO CORP.) | 8 parts by weight |

| (Gray Toner $G_3$) | |
|---|---|
| Colorant: carbon black (trade name: Mogul L, made by CABOT CORPORATION) | 0.5 parts by weight |
| Electrically Conductive Fine Particles: electroconductive titanium dioxide (trade name: FT-1000, made by ISHIHARA TECHNO CORP.) | 9 parts by weight |

| (Gray Toner $G_4$) | |
|---|---|
| Colorant: carbon black (trade name: Mogul L, made by CABOT CORPORATION) | 0.2 parts by weight |
| Electrically Conductive Fine Particles: electroconductive titanium dioxide (trade name: FT-1000, made by ISHIHARA TECHNO CORP.) | 10 parts by weight |

| (Black Toner $K_1$) | |
|---|---|
| Colorant: carbon black (trade name: Mogul L, made by CABOT CORPORATION) | 10 parts by weight |
| Electrically Conductive Fine Particles: electroconductive titanium dioxide (trade name: FT-1000, made by ISHIHARA TECHNO CORP.) | 0 part by weight |

| (Yellow Toner $Y_5$) | |
|---|---|
| Colorant: yellow pigment (trade name: Toner Yellow HG, made by CLARIANT CORPORTION) | 8 parts by weight |

| (Magenta Toner $M_5$) | |
|---|---|
| Colorant: magenta pigment (trade name: Toner Magenta EB, made by CLARIANT CORPORTION) | 7 parts by weight |

| (Cyan Toner $C_5$) | |
|---|---|
| Colorant: cyan pigment (trade name: Lionol Blue ES, made by TOYO INK MFG. CO., LTD.) | 5 parts by weight |

| (White Toner $W_5$) | |
|---|---|
| Colorant: white pigment (tradename: KA-30S, made by TITAN KOGYO KABUSHIKI KAISHA) | 10 parts by weight |

| (Gray Toner $G_5$) | |
|---|---|
| Colorant: carbon black (trade name: Mogul L, made by CABOT CORPORATION) | 2 parts by weight |

Then, the yellow toner $Y_1$, the magenta toner $M_1$ and the cyan toner $C_1$ were mixed with the white toner $W_1$ to $W_4$ to prepare Examples 1 to 11. The yellow toner $Y_1$, the magenta toner $M_1$ and the cyan toner $C_1$ were mixed with the gray toner $G_1$ to $G_4$ or the black toner $K_1$ to prepare Reference Examples 1 to 15. The yellow toner $Y_5$, the magenta toner $M_5$ and the cyan toner $C_5$ were mixed with the white toner $W_5$, the gray toner $G_5$ or the black toner $K_1$ to prepare Comparative Examples 1 to 3. Examples 1 to 11, Reference Examples 1 to 15 and Comparative Examples 1 to 3 will be described below.

Incidentally, FIG. 5 collectively shows composition ratios in Examples, Reference Examples and Comparative Examples, and FIG. 6 collectively shows results of measurement of $R_H/R_L$, color characteristic before and after printing and color difference ΔE.

Refer to FIG. 5.

EXAMPLE 1

Achromatic color toner and chromatic color toner were mixed at the following ratio by a Henschel mixer to prepare light brown toner.

| | |
|---|---|
| Achromatic color toner (white toner $W_1$) | 50 parts by weight |
| Chromatic color toner (yellow toner $Y_1$) | 25 parts by weight |
| Chromatic color toner (magenta toner $M_1$) | 25 parts by weight |

In the light brown toner, the ratio $R_H/R_L$ electrical resistivity of the yellow toner $Y_1$ relatively high in electrical resistivity to electrical resistivity of the magenta toner $M_1$ relatively low in electrical resistivity was as follows.

$$R_H/R_L=12\ G\Omega\cdot cm/8\ G\Omega\cdot cm=1.5$$

A two-component developing agent obtained by mixing 5 parts by weight of light brown toner and 95 parts by weight of silicone resin-coated magnetite carrier (made by KANTO DENKA KOGYO CO., LTD.) with each other in a ball mill was used in the aforementioned color laser printer for performing a print test of 100,000 copies so that print color stability was evaluated.

An initial print color measured was L*=68, a*=14 and b*=25. A print color measured after printing of 100,000 copies was L*=71, a*=15 and b*=26. The color difference ΔE between the print colors before and after continuous printing was 3.3. There was little change in print color. It was found that print color stability was high.

Incidentally, the color difference ΔE is defined by the equation:

$$\Delta E=\{(L^*_A-L^*_B)^2+(a^*_A-a^*_B)^2+(b^*_A-b^*_B)^2\}^{1/2}$$

when the coordinates of the color before printing are ($L^*_A$, $a^*_A$, $b^*_A$), and the coordinates of the color after printing are ($L^*_B$, $a^*_B$, $b^*_B$).

EXAMPLES 2 TO 5

Print color stability was evaluated in the same manner as in Example 1 except that brown toner different in lightness, prepared in the condition that the mixture ratio of achromatic color toner to chromatic color toner was changed in a range of from 90:10 to 10:90 as shown in FIG. 5 was used for evaluation.

As shown in FIG. 6, the color difference ΔE between print colors before and after printing of 100,000 copies was in a range of from 2.8 to 3.2. There was little change in print color. It was found that print color stability was high.

Incidentally, in each of Examples 2 to 5, the ratio $R_H/R_L$ was 1.5.

EXAMPLES 6 TO 8

Print color stability was evaluated in the same manner as in Example 1 except that light brown toner prepared in the condition that white toner $W_2$ to $W_4$ different in the amount of added white pigment was used as the achromatic color toner as shown in FIG. 5 was used for evaluation.

As shown in FIG. 6, the color difference ΔE between print colors before and after printing of 100,000 copies was in a range of from 1.0 to 5.0. There was little change in print color. It was found that print color stability was high.

Incidentally, the ratio $R_H/R_L$ was in a range of from 1.25 to 1.88.

EXAMPLES 9 TO 11

Print color stability was evaluated in the same manner as in Example 1 except that various kinds of color toner having various color tones and prepared as a mixture of yellow toner $Y_1$, magenta toner $M_1$ and cyan toner $C_1$ as the chromatic color toner as shown in FIG. 5 were used for evaluation.

As shown in FIG. 6, the color difference ΔE between print colors before and after printing of 100,000 copies was in a range of from 2.4 to 4.9. There was little change in print color. It was found that print color stability was high.

Incidentally, the ratio $R_H/R_L$ was in a range of from 1.67 to 1.88.

Reference Examples 1 TO 5

Print color stability was evaluated in the same manner as in Examples 1 to 5 except that dark brown toner different in lightness, prepared in the condition that black toner $K_1$ was used as the achromatic color toner as shown in FIG. 5 was used for evaluation.

As shown in FIG. 6, the color difference ΔE between print colors before and after printing of 100,000 copies was in a range of from 2.2 to 3.7. There was little change in print color. It was found that print color stability was high.

Incidentally, in each of Reference Examples 1 to 5, the ratio $R_H/R_L$ was 1.5.

Reference Examples 6 TO 10

Print color stability was evaluated in the same manner as in Examples 1 to 5 except that dark brown toner different in lightness, prepared in the condition that gray toner $G_1$ was used as the achromatic color toner as shown in FIG. 5 was used for evaluation.

As shown in FIG. 6, the color difference ΔE between print colors before and after printing of 100,000 copies was in a range of from 1.4 to 2.4. There was little change in print color. It was found that print color stability was high.

Incidentally, in each of Reference Examples 6 to 10, the ratio $R_H/R_L$ was 1.5.

Reference Examples 11 TO 13

Print color stability was evaluated in the same manner as in Example 1 except that dark brown toner prepared in the condition that gray toner $G_2$ to $G_4$ different in the amount of added carbon black was used as the achromatic color toner as shown in FIG. 5 was used for evaluation.

As shown in FIG. 6, the color difference ΔE between print colors before and after printing of 100,000 copies was in a range of from 3.2 to 4.6. There was little change in print color. It was found that print color stability was high.

Incidentally, the ratio $R_H/R_L$ was in a range of from 1.5 to 1.88.

Reference Examples 14 AND 15

Print color stability was evaluated in the same manner as in Example 1 except that green toner prepared as a mixture of yellow toner $Y_1$ and cyan toner $C_1$ as the chromatic color toner as shown in FIG. 5 was subjected to evaluation.

As shown in FIG. 6, the color difference ΔE between print colors before and after printing of 100,000 copies was in a range of from 2.0 to 3.7. There was little change in print color. It was found that print color stability was high.

Incidentally, in each of Reference Examples 14 and 15, the ratio $R_H/R_L$ was 1.5.

Comparative Example 1

Color toner (light brown) was evaluated in the same manner as in Example 1 except that achromatic color toner and chromatic color toner were mixed at the following ratio without addition of electrically conductive fine particles, that is, without control of electrical resistivity of toner.

Achromatic color toner (white toner $W_5$) 50 parts by weight

Chromatic color toner (yellow toner $Y_5$) 25 parts by weight

Chromatic color toner (magenta toner $M_5$) 25 parts by weight

As shown in FIG. 6, an initial print color measured was L*=72, a*=13 and b*=23. A print color measured after printing of 100,000 copies was L*=61, a*=15 and b*=29. The color difference ΔE between the print colors before and after continuous printing was 12.7. Change in print color was observed. It was found that print color stability was low.

Incidentally, the ratio $R_H/R_L$ was 3.3.

Comparative Example 2

Color toner (dark brown) was evaluated in the same manner as in Comparative Example 1 except that gray toner $G_5$ was used without addition of electrically conductive fine particles as achromatic color toner, that is, without control of electrical resistivity of toner as shown in FIG. 5.

As shown in FIG. 6, the color difference ΔE between the print colors before and after printing of 100,000 copies was 8.8. Change in print color was observed. It was found that print color stability was low.

Incidentally, the ratio $R_H/R_L$ was 2.5.

Comparative Example 3

Color toner was evaluated in the same manner as in Comparative Example 1 except that black toner $K_1$ was used as the achromatic color toner as shown in FIG. 5.

As shown in FIG. 6, the color difference ΔE between the print colors before and after printing of 100,000 copies was 23.0. Change in print color was observed. It was found that print color stability was low.

Incidentally, the ratio $R_H/R_L$ was 15.

It is obvious from the evaluation results that toner obtained in each of Examples 1 to 11 is good in stability because the print color even after the test of printing of 100,000 copies changes little compared with the initial print color whereas toner obtained in each of Comparative Examples 1 to 3 is poor in stability because the print color widely varies according to printing.

Incidentally, toner obtained in each of Reference Examples 1 to 15 for the sake of reference exhibits a good result like toner obtained in each of Examples 1 to 11 because the print color even after the test of printing of 100,000 copies changes little compared with the initial print color.

Figure 7:
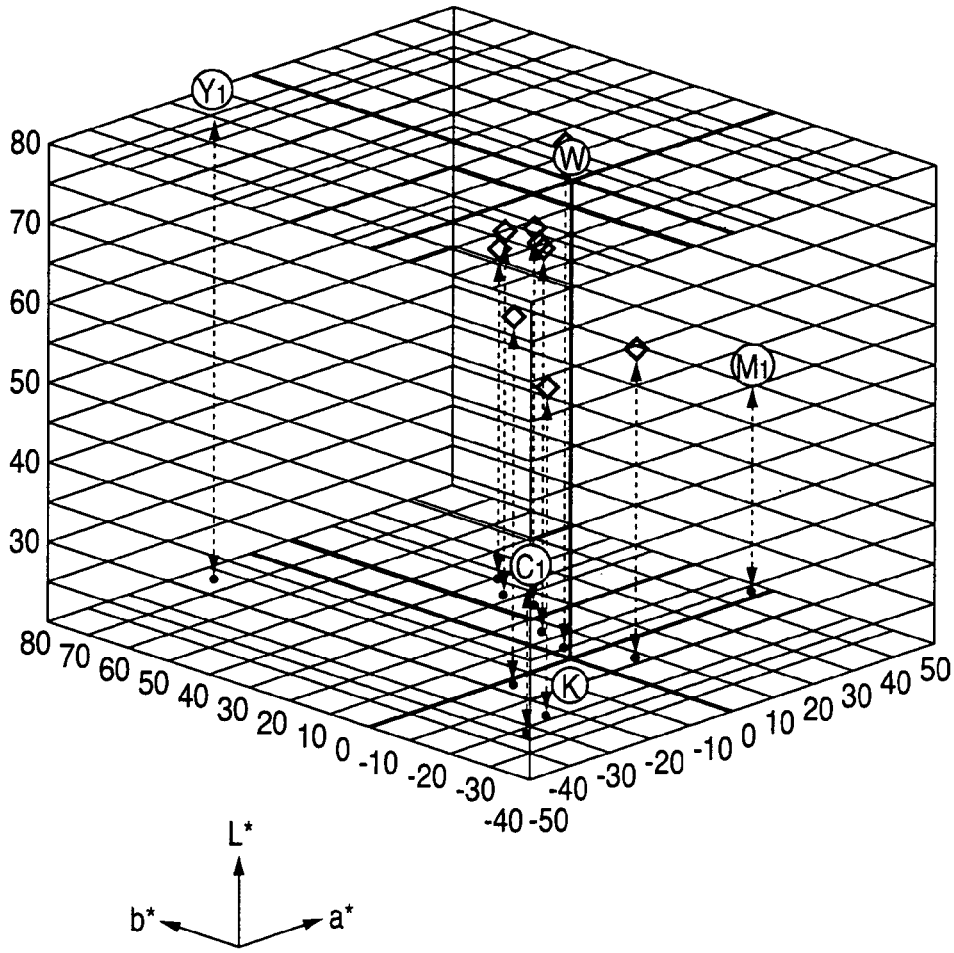
FIG. 7 is a graph for explaining a color reproduction region of color toner according to the embodiment of the invention.

Refer to FIG. 7.

FIG. 7 typically shows a color reproduction range of color toner according to the invention. Mixing of chromatic color toner and achromatic color toner makes it possible to reproduce all colors in a space enclosed in a curved surface connecting a point W to a closed curve Y-L-A-B-M-D-E-F-C-G-H-J-Y obtained by mixing of only chromatic color toner.

Though not shown, the same color reproduction range as that in the invention can be provided in the case of Reference Examples, especially in the case of Reference Example 1.

In the case of Reference Examples, it is possible to reproduce all colors in a space enclosed in two curved surfaces (not shown) connecting black and gray points to the closed curve Y-L-A-B-M-D-E-F-C-G-H-J-Y.

Figure 8:
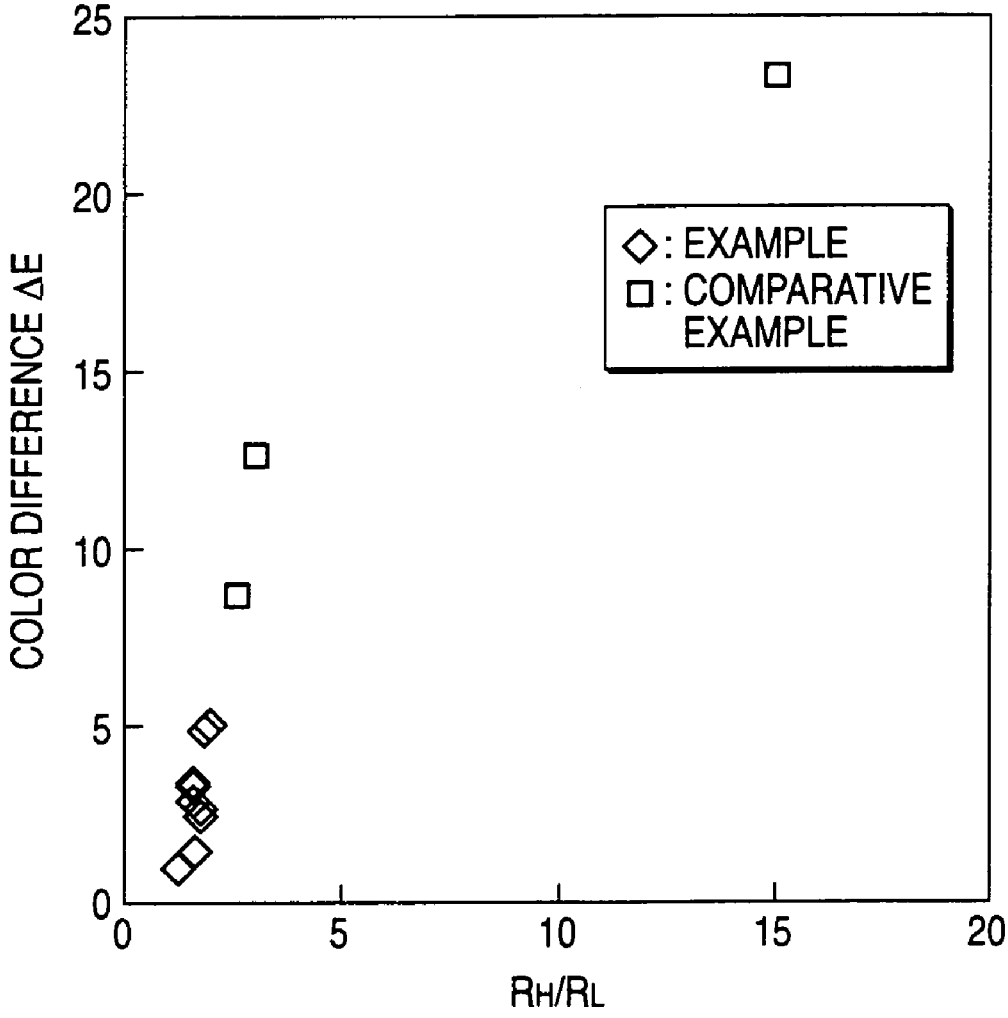
FIG. 8 is a graph for explaining $R_H/R_L$ dependence of the color difference ΔE of color toner.
Figure 9:
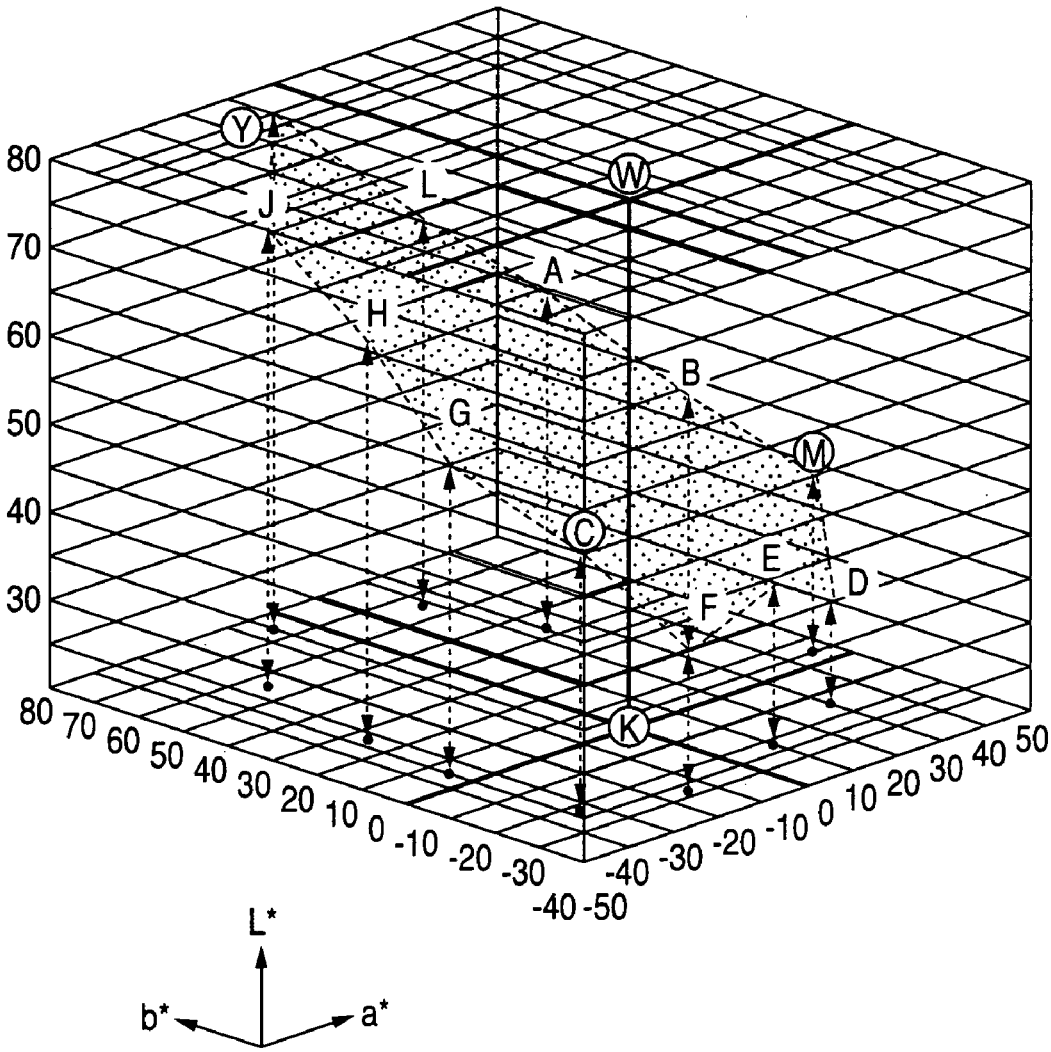
FIG. 9 is a graph for explaining a color reproduction region of color toner according to the related art.

Refer to FIG. 8.

FIG. 8 is a graph for explaining $R_H/R_L$ dependence of the quantity of change imprint color, that is, the color difference ΔE in each of Examples 1 to 11 and Comparative Examples 1 to 3. It is to be understood from FIG. 8 that change in print color increases as the electrical resistivity ratio $R_H/R_L$ increases, that is, the print color stability of color toner prepared as a mixture of kinds of toner widely different in electrical resistivity becomes low.

It is therefore obvious that stabilization of charge can be attained to thereby attain stabilization of the print color when the electrical resistivity ratio $R_H/R_L$ is selected to be not higher than 2.

Incidentally, such electrical resistivity of toner can be controlled easily by addition of electrically conductive fine particles. With respect to chromatic color toner $Y_5$, $M_5$ and $C_5$, achromatic color toner $W_5$ and $G_5$ and black toner $K_1$, electrically conductive fine particles are not added. Accordingly, electrical resistivity of toner varies widely in a range of from 10 GΩ·cm to 150 GΩ·cm because of the influence of the colorant. Accordingly, print color stability cannot be obtained though a good result of the color reproduction range can be obtained.

On the contrary, with respect to chromatic color toner $Y_1$, $M_1$ and $C_1$ and achromatic color toner $W_1$ to $W_4$ and $G_1$ to $G_4$, electrically conductive fine particles are added in accordance with the electrical resistivity of each colorant. Accordingly, electrical resistivity of toner is controlled to be in a narrow range of from 8 GΩ·cm to 15 GΩ·cm.

Although Examples have been described on the case where three kinds of toner having three hues, namely, yellow, magenta and cyan, are used as three kinds of chromatic color toner to be combined, the invention may be also applied to the case where another hue system of color toner is used.

For example, kinds of toner having hues, namely, green, blue and red may be combined.

According to the embodiment of the invention, at least one kind of chromatic color toner is mixed with white toner, so that diversified print colors having various kinds of lightness and various kinds of color tones can be provided. Furthermore, because the kinds of toner mixed are substantially equalized in electrical resistivity, the kinds of toner mixed can be consumed evenly so that a stable print image can be obtained. Accordingly, this makes a great contribution to spread of a high-quality image forming apparatus.

What is claimed is:

1. An electrophotographic color toner comprising:

a white toner; and a chromatic color toner, wherein:

the white toner and the chromatic color toner each includes a colorant, a binder resin, and an additive;

the white toner and the chromatic color toner are mixed;

the colorant of the white toner is selected from a group consisting of silver white pigment, titanium white pigment, zinc white pigment, and titanium strontium white pigment;

the additive of the white toner is electrically conductive fine particles; and the electrically conductive particles have electrical resistivity in a range of from 1 Ω·cm to 100 Ω·cm.

2. The electrophotographic color toner according to claim 1, wherein a print color of the chromatic color toner satisfies a relation $(a^*)^2+(b^*)^2 \geqq 10$ in an L*a*b* color space.

3. The electrophotographic color toner according to claim 1, wherein a print color of the white toner satisfies a relation $(a^*)^2+(b^*)^2 \leqq 5$ in an L*a*b* color space.

4. The electrophotographic color toner according to claim 1, wherein a print color of the white toner satisfies a relation $L^* \geqq 80$ in an L*a*b* color space.

5. The electrophotographic color toner according to claim 1, wherein:

the additive of the chromatic color toner and the additive of the white toner are electrically conductive fine particles; and an amount of the additive of the chromatic color toner is different from that of the additive of the white toner.

6. The electrophotographic color toner according to claim 1, wherein:

the chromatic color toner is at least one chromatic color toner;

$R_H/R_L$ is not higher than 2 where $R_H$ denotes electrical resistivity of a toner having the highest electrical resistivity among the white toner and the chromatic color toner, and $R_L$ denotes resistivity of a toner having the lowest electrical resistivity among the white toner and the chromatic color toner.

7. The electrophotographic color toner according to claim 1, wherein:

the chromatic color toner is at least one chromatic color toner;

each chromatic color toner includes 75 to 95 parts by weight of the binder resin and 0.1 to 20 parts by weight of the colorant when the total amount of each chromatic color toner is 100 parts by weight.

8. The electrophotographic color toner according to claim 1, wherein the colorant of the white toner includes a titanium oxide having a particle size in a range of from 10 nm to 1,000 nm.

9. The electrophotographic color toner according to claim 1, wherein the colorant of the white toner has electrical resistivity in a range of from $1\times10^8$ Ω·cm to $1\times10^{12}$ Ω·cm.

10. The electrophotographic color toner according to claim 1, wherein the additive of the chromatic color toner and the additive of the white toner are one of colorless electrically conductive fine particles and white electrically conductive fine particles.

11. The electrophotographic color toner according to claim 1, wherein the additive of the chromatic color toner and the additive of the white toner are electrically conductive fine particles having electrical resistivity in a range of 1 Ω·cm to 100 Ω·cm.

12. The electrophotographic color toner according to claim 1, wherein the additive of the chromatic color toner and the additive of the white toner are electrically conductive fine particles having an aspect ratio being not lower than 10 and having an long axis size being not larger than 4 μm.

13. The electrophotographic color toner according to claim 1, wherein each of the additive of the chromatic color toner and the additive of the white toner has at most 20 wt %.

14. The electrophotographic color toner according to claim 1, wherein the additive of the chromatic color toner and the additive of the white toner are selected from a group consisting of ZnO, $TiO_2$, $SnO_2$, $Sb_2O_3$, $In_2O_3$, $SiO_2$, MgO, BaO, $MoO_3$ and WO.

15. The electrophotographic color toner according to claim 1, wherein:

the additive of the chromatic color toner and the additive of the white toner are $TiO_2$ particles having a long axis size being not smaller than 1 μm and having a short axis size being not larger than 0.1 μm.

16. The electrophotographic color toner according to claim 1, wherein:

the additive of the chromatic color toner and the additive of the white toner are $TiO_2$ particles, which are coated with a electric conductive layer including $SnO_2$ and $Sb_2O_3$.

17. The electrophotographic color toner according to claim 17, wherein:

an amount of $Sb_2O_3$ included in the electric conductive layer is in a range of from 10 wt % to 25 wt % with respect to an amount of $SnO_2$.

18. The electrophotographic color toner according to claim 1, wherein:

the chromatic color toner is coated with inorganic fine particles having a particle size in a range of from 5 nm to 2 μm.

19. The electrophotographic color toner according to claim 18, wherein:

an amount of the inorganic fine particles is in a range of 0.1 part by weight to 5 part by weight when an amount of the chromatic color toner is 100 part by weight.

* * * * *